US005375897A

United States Patent [19]

Gazel-Anthoine

[11] Patent Number: 5,375,897

[45] Date of Patent: Dec. 27, 1994

[54] WELL PIPE ELEVATOR FOR WELL DRILLING

[75] Inventor: Gazel-Anthoine, Rueil Malmaison, France

[73] Assignee: Plateformes Et Structures Oceaniques, Rueil-Malmaison, France

[21] Appl. No.: 28,667

[22] Filed: Mar. 5, 1993

[30] Foreign Application Priority Data

Mar. 5, 1992 [FR] France ..... 92 02645

[51] Int. Cl.[5] ..... B66C 1/62; E21B 31/18

[52] U.S. Cl. ..... 294/86.29; 294/86.33; 294/88; 294/113

[58] Field of Search ..... 294/86.26, 86.27, 86.29, 294/86.33, 88, 90, 113, 114, 110.1

[56] References Cited

U.S. PATENT DOCUMENTS

| | | | |
|---|---|---|---|
| 1,555,205 | 9/1925 | Hill | 294/90 |
| 1,634,935 | 7/1927 | Donnelly | 294/86.33 |
| 2,410,262 | 10/1946 | Breaux | 294/86.29 X |
| 2,852,301 | 9/1958 | Gentry | 294/114 |
| 3,743,342 | 7/1973 | Kell | 294/86.33 X |
| 3,795,420 | 3/1974 | Preston, Jr. | 294/86.33 X |
| 3,845,963 | 11/1974 | Price | 294/90 X |
| 3,952,384 | 4/1976 | Goldry et al. | 294/113 X |
| 4,511,169 | 4/1985 | Willis | 294/116 |
| 4,522,439 | 6/1985 | Haney | 294/110.1 |
| 4,585,369 | 4/1986 | Manesse et al. | 294/86.33 X |
| 4,650,235 | 3/1987 | Shaginian et al. | 294/113 X |
| 4,743,055 | 5/1988 | Dantan | 294/88 |

FOREIGN PATENT DOCUMENTS

| | | |
|---|---|---|
| 2585065 | 1/1987 | France . |
| 1238220 | 7/1971 | United Kingdom . |

*Primary Examiner*—Dean J. Kramer
*Attorney, Agent, or Firm*—Young & Thompson

[57] ABSTRACT

A well pipe elevator comprises a ring having an interior volume and adapted to be fitted over a pipe from above and one or more tongues carried by the ring. The tongue mounted for movement between a retracted position (I) for fitting the elevator to the pipe and a deployed position (III) for retaining the pipe. The tongue projects minimally into the interior volume of ring in the retracted position and maximally into the interior volume in the deployed position. The tongue has a rest position intermediate the retracted and deployed positions. The biasing spring is coupled at one end to the tongue and at the other end to an actuating member. A retractor is provided for controlling the actuating member displaceable between an advanced position corresponding to the rest, intermediate position of the tongue and a withdrawn position corresponding to the deployed position of the tongue.

13 Claims, 3 Drawing Sheets

WELL PIPE ELEVATOR FOR WELL DRILLING

The present invention is generally concerned with elevators for handling a string of well pipes.

It concerns, in particular, elevators used on drilling installations to lower and raise drilling pipes which are assembled together or unfastened from each other as they are lowered and raised, respectively.

Drilling pipes are assembled together by screwing them together, their ends being screwthreaded for this purpose.

These screwthreads are formed in an enlarged end portion by which the pipes are usually held.

In prior art drilling installations the elevators employed for this purpose comprise two jaws which close around a pipe at the level of its enlarged upper end portion by radial movement relative to the pipe parallel to the plane of the drilling platform.

This arrangement has given satisfaction and may continue to do so.

However, it has the drawback that it is difficult to mechanize and entails a specific operation to close the jaws, which is detrimental to productivity.

A general object of the present invention is an arrangement whereby this drawback may be avoided.

To be more precise, the invention consists in a well pipe elevator characterized in that it comprises a ring adapted to be fitted over a pipe from above and at least one tongue carried by said ring and mobile between a retracted position in which, for fitting the elevator to the pipe, it projects minimally into the interior volume of said ring and a deployed position in which it projects maximally into said interior volume in order to retain the pipe.

Thus an elevator in accordance with the invention has only to be fitted over a pipe from above for the tongues that it incorporates to retract as they pass over the pipe exclusively by virtue of the force applied to them by the latter.

In accordance with the invention the tongue(s) are further subject to the action of at least one return spring so that when at rest they occupy an intermediate position between their deployed position and their retracted position.

Thus when they move from their rest position to their retracted position, exclusively by virtue of the force applied to them by the pipe to be grasped, they return of their own accord to the rest position, engaged under the enlarged upper end portion of the pipe, provided that the elevator is lowered far enough for this to occur.

When the elevator is raised the tongue(s) that it comprises move from their rest position to their deployed position, exclusively by virtue of the force applied to them by the pipe with which they are engaged at this time.

When loaded in this way the tongue(s) are obliged to remain in the deployed position, which enhances safety.

They then hold the string of pipes securely and reliably.

In accordance with the invention, the movement under load of the tongue(s) from their rest position to their deployed position is employed to ensure that subsequently they are raised to the retracted position when the load on them is removed.

To this end the return spring is coupled to an actuator member under the control of retractor means and mobile between two positions, namely an advanced position associated with the rest position of the tongue(s) and a withdrawn position associated with their retracted position.

Thus when the tongue(s) are in the deployed position the return spring(s) are sufficiently stressed to return them to their retracted position, beyond their rest position, when the elevator is lowered far enough to relieve them of the load which until this time has held them in the rest position.

Thus all that is required to disengage the elevator in accordance with the invention from a pipe is to lower it far enough for its tongue(s) to move to the retracted position and then to raise it, time-delay means holding the tongue(s) in the retracted position for as long as necessary.

The retractor means controlling the actuator member controlling the return spring(s) of the tongue(s) of this elevator are preferably controlled by the tongues themselves.

Thus lowering or raising the elevator in accordance with the invention automatically operates the tongues, without requiring any other action, to the benefit of productivity.

Only this raising or lowering is required and these operations are easy to mechanize and control.

The elevator in accordance with the invention advantageously has relatively compact overall dimensions, being contained entirely within the overall dimensions of its ring, and it is therefore advantageously able to pass through the screwing machine, if any, as it assembles together and unfastens the pipes.

The features and advantages of the invention will emerge from the following description given by way of example with reference to the appended diagrammatic drawings in which.

Figure 1:
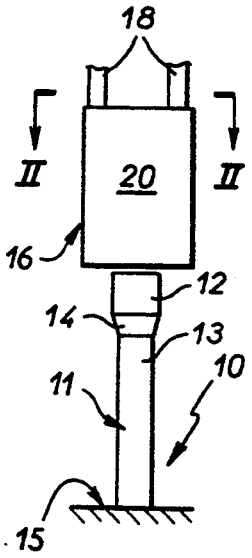
FIG. 1 is a view in elevation of an elevator in accordance with the invention and part of the top pipe of a string of pipes it is adapted to handle.

As shown diagrammatically in FIGS. 1 and 8A, 8B, 8C, 8D the overall objective is to handle a string 10 of pipes comprising a succession of pipes 11 which are screwed together end-to-end and which all have, where they join together, an enlarged portion 12 merging with their main part 13 through a frustoconical bearing surface 14.

In a drilling installation, the objective is more particularly to raise or lower the string 10 of pipes which is suspended from a drilling platform 15 by wedges (not shown).

In either case an elevator 16 adapted to grip the top pipe 11 at its enlarged upper end portion 12 is used to hold the pipe string by the top pipe 11.

The elevator 16 is in practice slung by suspension members 18 from the mobile pulley block of lifting machinery (not shown).

These arrangements are well known in themselves and as they are not relevant to the present invention they are not described in more detail here.

Figure 3:
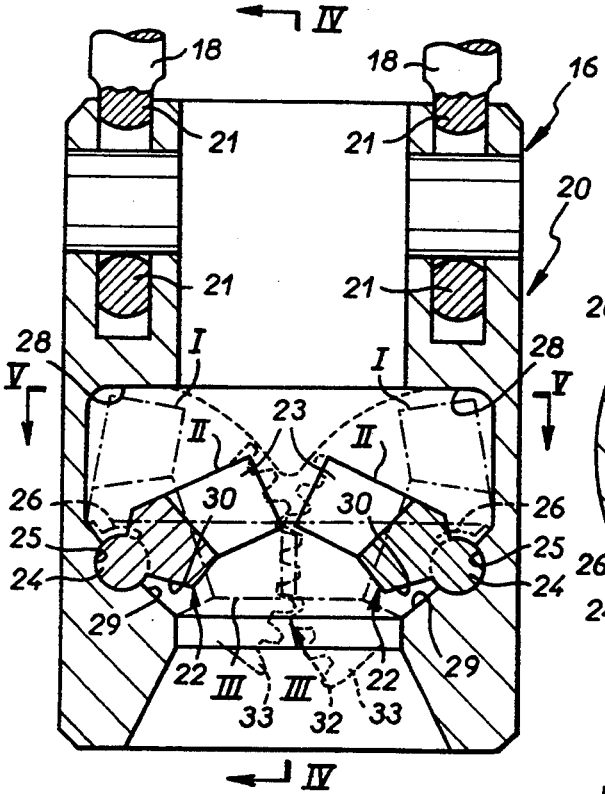
FIG. 3 is a view of it in axial cross-section on the line III—III in FIG. 2.
Figure 7A:
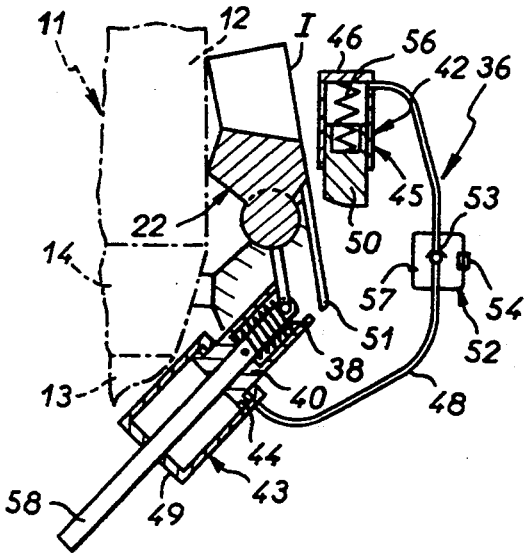
FIGS. 7A, 7B, 7C are diagrammatic views in axial cross-section analogous to that of FIG. 6 and showing the operation of the position control means.
Figure 7B:
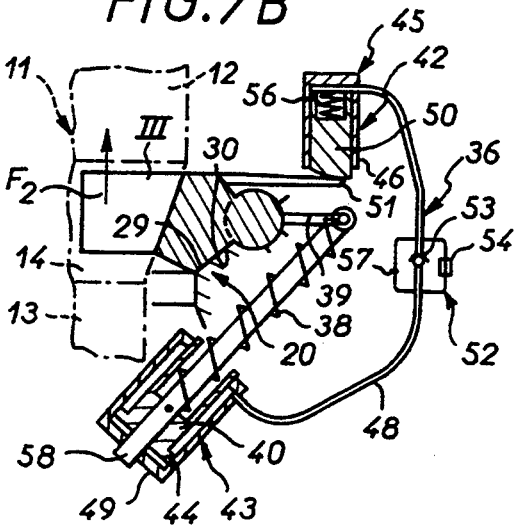

In accordance with the invention the elevator 16 comprises a ring 20 adapted to be fitted from above over the pipe 11 to be grasped and to which the suspension members 18 are attached by lugs 21 and at least one tongue 22 carried by the ring 20 inside it and mobile between two extreme positions, namely a retracted position I shown in chain-dotted outline in FIG. 3 and in full line in FIG. 7A and in which it projects minimally into the interior volume of the ring 20 to allow it to be fitted over a pipe 11 and a deployed position III shown in chain-dotted outline in FIG. 3 and in full line in FIG. 7B in which it projects maximally into this interior volume to retain the pipe 11.

There are preferably at least two tongues 22.

In the specific embodiment shown there are only two tongues 22, in diametrally opposite positions, and they rotate about respective parallel axes which are orthogonal to the axis of the ring 20.

To be more precise, in this embodiment the tongues 22 operate symmetrically to each other relative to an axial plane of the ring 20 and at their free end each forms a fork 23 by which they are adapted to bear on a pipe 11 over a circular sector which in practice subtends an angle of slightly less than 180°, either directly or through the intermediary of adapter fittings (not shown) attached to the fingers of the fork 23.

To articulate it to the ring 20 each tongue 22 incorporates a spindle 24 in one piece with the fork 23.

Figure 5:
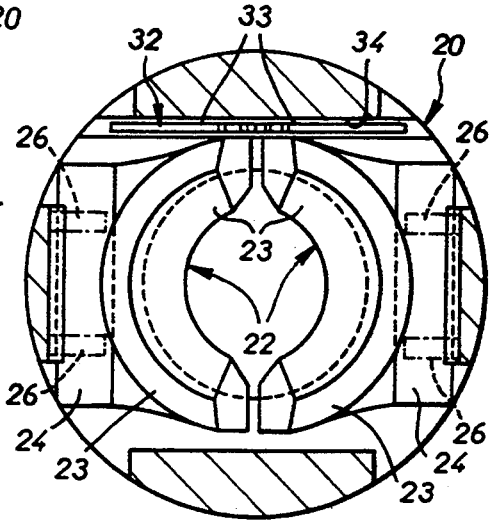
FIG. 5 is a view of it in transverse cross-section on the line V—V in FIG. 3.
Figure 4:
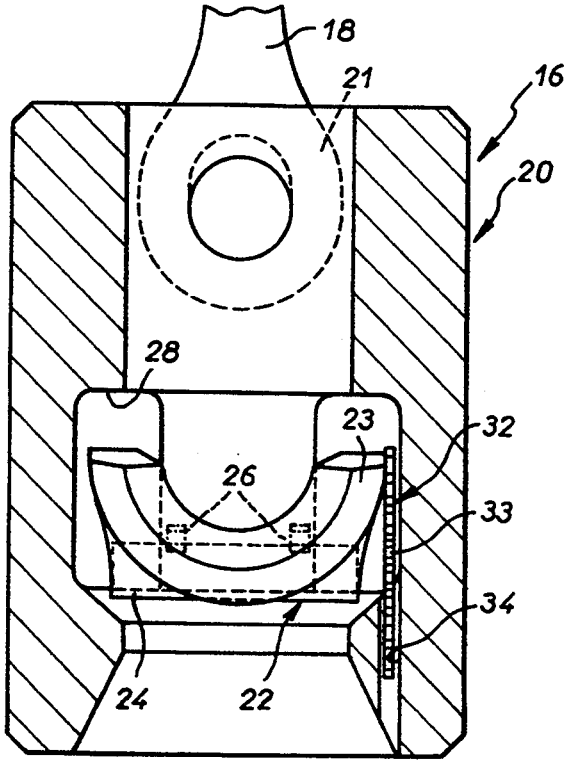
FIG. 4 is a view of it in axial cross-section on the line IV—IV in FIG. 3.

The spindle 24 of each tongue 22 fits in a groove 25 of semi-circular transverse cross-section in the ring 20 and, as shown diagrammatically in chain-dotted line in FIGS. 3, 4 and 5, two spaced half-bearings 26 attached to the ring 20 hold the tongues in place by bearing engagement on the spindle 24.

The ring 20 has inside it and in positions diametrally opposite each other two recesses 28 in which the respective tongues 22 are accommodated in the retracted position I and two shoulders 29 on which they bear in the deployed position III.

The shoulders 29 are oblique to the axis of the ring 20, converging in the direction away from the suspension members 18. Each tongue 22 incorporates a corresponding shoulder 30.

These are frustoconical shoulders with a circular base.

If two tongues 22 are used, as in this example, synchronization means 32 are operative between them.

In the specific embodiment shown in FIGS. 1 through 9 the synchronization means 32 comprise two toothed sectors 33 accommodated in a slot 34 in the ring 20, meshing together and rotating with the respective tongues 22.

These arrangements will not be described in more detail here as they will be obvious to the man skilled in the art.

Likewise, it is only to simplify the figures that the ring 20 has been shown as being in one part in the axial direction.

Evidently, it may in practice be made in two parts, an upper part and a lower part appropriately fitted and joined together, to facilitate machining or to facilitate the fitting of the tongues 22.

However, the ring 20 is preferably in one piece in the circumferential direction, as shown.

In addition to the synchronization means 32, position control means 36 are associated with at least one of the tongues 22.

Like the synchronization means 32, the position of control means 36 are accommodated inside the ring 20.

To simplify the figures they are not shown in FIGS. 3, 4 and 5, however.

They are represented schematically, for one tongue 22, in FIGS. 6, 7A, 7B and 7C.

To clarify these figures the component parts shown in them, described in detail hereinafter, have been deliberately shown larger than is necessary.

They are accommodated under the spindles 24 of the tongues 22 and/or over the volume swept out by the latter, for example.

The position control means 36 comprise a return spring 38 such that, when at rest, a tongue 22 occupies an intermediate position II between its retracted position I and its deployed position III.

The return spring 38 is coupled to the tongue 22 at one end via an arm 39 fastened to it.

The other end of the return spring 38 is coupled to an actuator member 40 controlled by retractor means 42 to be described in more detail later and mobile between two positions, namely an advanced position (FIGS. 6 and 7A) normally associated with the rest position II of the tongue 22 and a withdrawn position (FIGS. 7B and 7C) normally associated with the retracted position I of the tongue 22.

The control member 40 and the retractor means 42 are part of the position control means 36, together with the return spring 38.

Figure 6:
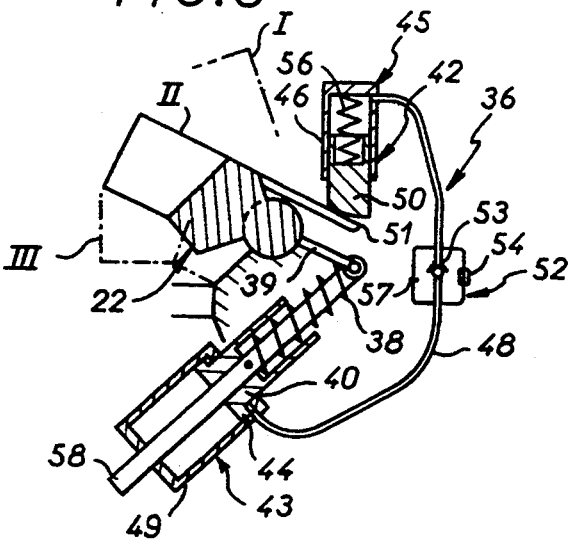
FIG. 6 is a diagrammatic view in axial cross-section of one of its tongues and the associated position control means.

In the embodiment specifically shown in FIGS. 6 and 7 the retractor means 42 comprise a first piston-and-cylinder actuator 43 the piston 44 of which is attached to or in one piece with the actuator member 40 and a second piston-and-cylinder actuator 45 whose cylinder 46 is connected by a pipe 48 to the cylinder 49 of the first actuator 43 and whose piston 50 projects outwards into contact with the tongue 22.

The piston 50 operates on the tongue 22 through a second arm 51 of the latter, for example.

The pipe 48 is connected to the front portion of the cylinder 49 of the first actuator 43 and to the rear portion of the cylinder 46 of the second actuator 45.

The resulting retractor means 42 are preferably (as here) subject to the action of time-delay means 52 such as a dash-pot whereby return of the tongue 22 from its retracted position I to its rest position II is delayed.

The time-delay means 52 comprise a check valve 53 on the pipe 48 to prevent any flow of fluid in the pipe 48 in the direction from the first actuator 43 to the second actuator 45 and a throttled passage 54 branching from the check valve 53.

A return spring 56 bearing against the back of the cylinder 46 of the second actuator 45 urges the piston 50 of this actuator outwards at all times.

The return spring 56 is stronger than the return spring 38.

A manually operated valve 57 also branches from the check valve 53, in parallel with the throttled passage 54.

To prevent the return spring 38 from buckling the spring is threaded over a guide rod 58 articulated to the arm 39 of the tongue 22 and passing through the first actuator 43, to which it is sealed.

The elevator 16 in accordance with the invention is operated as follows.

Figure 8A:
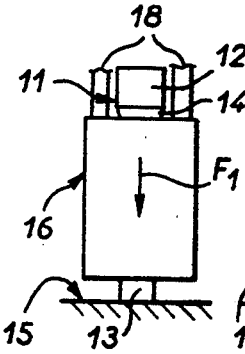
FIGS. 8A, 8B, 8C, 8D are views in elevation analogous to that of FIG. 1 and related to FIGS. 7A, 7B, 7C, showing various successive phases of use of the elevator in accordance with the invention.

Initially (FIGS. 1 and 8A) the ring 20 of the elevator 16 is fitted axially from above over the top pipe 11 of the string 10 of pipes to be handled, as shown by the arrow F1 in FIG. 8A.

The tongues 22 carried by the ring 20, initially in the rest position II, come into contact with the enlarged upper end portion 12 of the pipe 11 which pushes them back into the retracted position I (FIG. 7A).

This compresses the return spring 38. The piston 44 and therefore the actuator member 40 are held in the advanced position by the return spring 56.

The elevator 16 is lowered along the pipe 11 far enough for the tongues 22 to escape from the enlarged end portion 12.

The return spring 38 therefore returns them to the rest position II under the enlarged end portion 12.

Figure 8B:
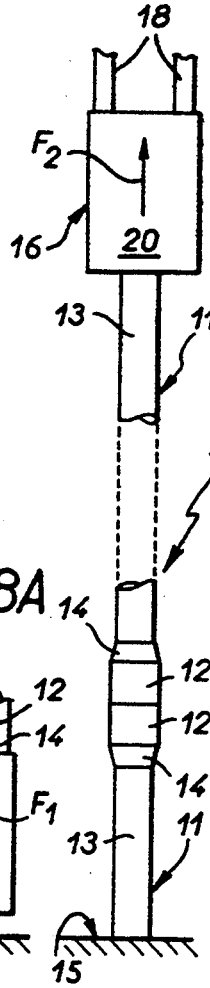

Then (FIG. 8B) the elevator 16 is raised, as shown by the arrow F2 in FIGS. 7B and 8B.

As soon as this movement begins the tongues 22 abut against the frustoconical bearing surface 14 of the pipe 11 which forces them to move from their rest position II to their deployed position III in which (see FIG. 7B) their shoulder 30 is urged against the respective shoulder 29 of the ring 20 entirely by the weight of the pipe 11.

At the same time the arm 51 depresses the piston 50 of the second actuator 45 of the retractor means 42 so that the expelled fluid deploys the piston 44 of the first actuator 43 (FIG. 7B).

The piston 44 moves the actuator member 40 from its advanced position to its withdrawn position, which loads the return spring 38.

As upward movement of the elevator 16 continues the tongues 22 on the ring 20 entrain the pipe 11 and, with it, the remainder of the string 10 of pipes (FIG. 8B).

As will be readily understood, the tongues 22 do not need to grip the pipe 11 in the deployed position III that they occupy at this time.

All that is required is that they retain the pipe by its enlarged end portion 12, in other words that they do not allow the enlarged end portion 12 to slip through them.

In the deployed position III there is preferably a clearance between the tongues 22 and the main part 13 of the pipe 11.

When the string 10 of pipes has been raised to the required height it is again locked in position relative to the drilling platform 15.

Figure 8C:
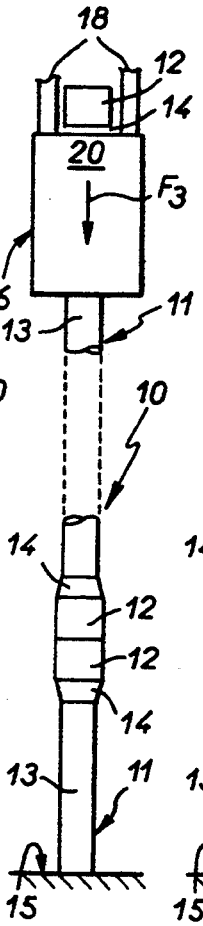

To remove the elevator 16 from the string 10 of pipes the first step, as shown by the arrow F3 in FIG. 8C, is to lower the ring 20 relative to the string 10 of pipes far enough for the tongues 22 to escape from the enlarged upper end 12 of the top pipe 11 of the string.

Figure 7C:
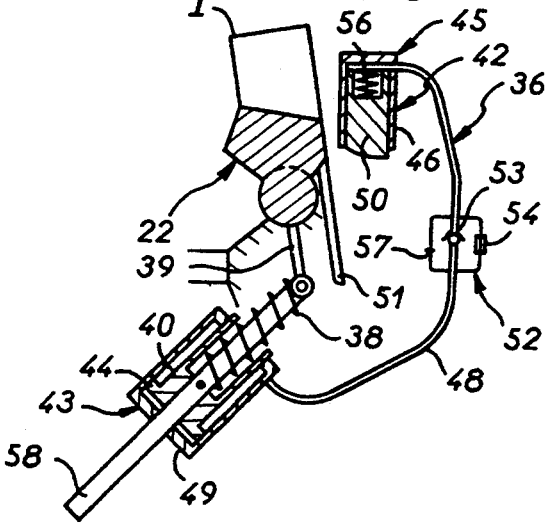

The return spring 38 then returns the tongues 22 to the retracted position I (FIG. 7C).

Because of the time-delay means 52 the actuator member 40 tensioning the return spring 38 remains in the withdrawn position long enough after the fluid expelling action of the piston 50 of the second actuator 45 has ceased for the tongues 22 to remain in the retracted position for as long as is necessary to disengage the elevator.

This takes three to four seconds, for example.

Figure 8D:
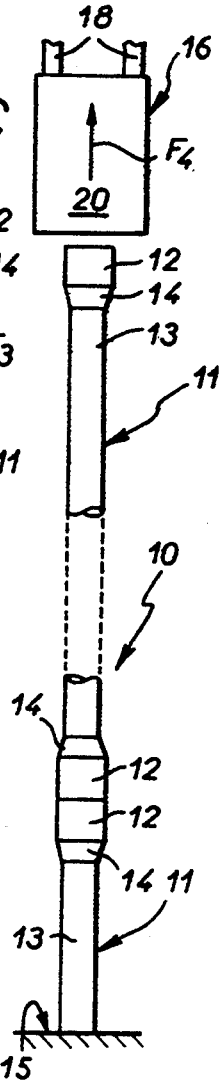
Figure 2:
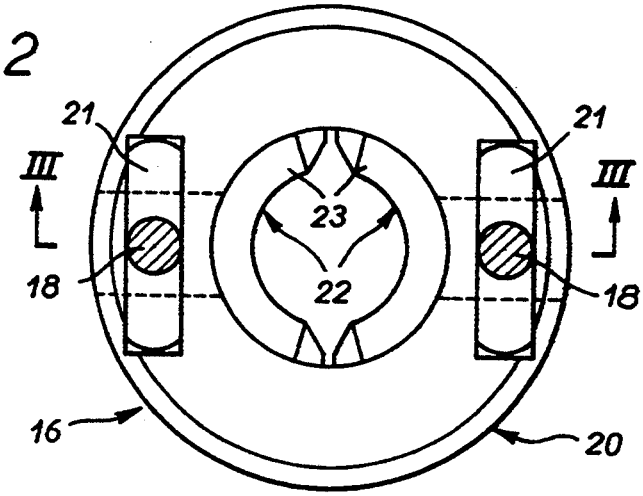
FIG. 2 is a plan view of the elevator to a larger scale and in cross-section on the line II—II in FIG. 1 showing the tongues it incorporates in a rest positions.

With the tongues 22 in the retracted position I the elevator 16 is disengaged simply by raising it as shown by the arrow F4 in FIG. 8D.

After this time-delay the return spring 56 of the piston 50 of the second actuator 45 of the retractor means returns all component parts of the position control means to their initial position.

The tongues 22 are then in the rest position II again and the elevator 16 in accordance with the invention is ready to be used again.

In an alternative embodiment (not shown), to modulate the delayed return of the tongues 22 to the rest position II the throttled passage 54 may be progressively opened up as soon as the pressure in the cylinder 46 of the second actuator 45 falls below that in the cylinder 49 of the first actuator 43.

Figure 9:
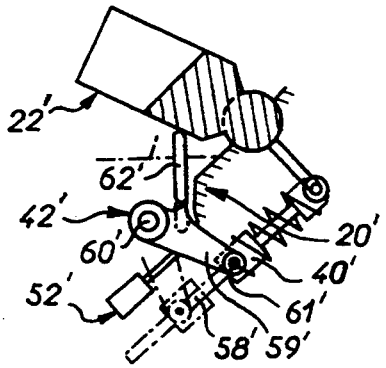
FIG. 9 is a diagrammatic view in axial cross-section analogous to that of FIG. 6 showing another embodiment.

In the embodiment shown in FIG. 9 the retractor means 42' comprise a lever 59' in place of the actuators 43 and 45', acting on the actuator member 40' and acted on itself by the tongue 22'.

The lever 59' rotates at 60' on the ring 20' and the actuator member 40' is articulated to it at 61'.

The tongue 22' acts on the lever 59' through a plunger 62' which slides in the ring 20'.

The time-delay means 52' which in this case return the position control means 36 and more specifically the actuator member 40' to the advanced position then comprise a dash-pot acting on the lever 59'.

Operation is similar to that previously explained.

Figure 10:
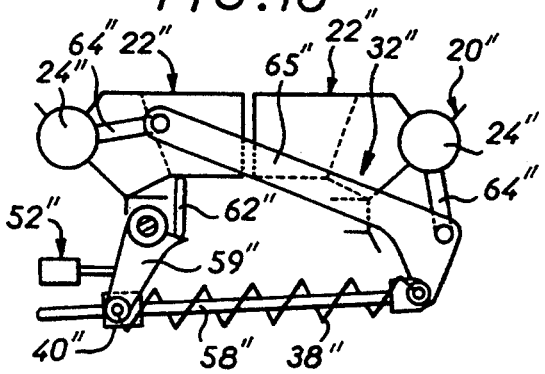
FIG. 10 is another diagrammatic view of the same kind as FIG. 6 and relating to a further embodiment.

In the embodiment shown in FIG. 10 the synchronization means 32" comprise a linkage operative between the two tongues 22" and comprising two levers 64" keyed to the respective tongues 22" and a link 65" articulated to both levers 64".

The return spring 38" is coupled to the link 65" and to the actuator member 40" which is articulated to the lever 59", as previously.

Also as previously, the tongue 22" acts on the lever 59" through a plunger 62".

The present invention is not limited to the embodiments described and shown but encompasses any variant execution of their various component parts.

Specifically, the number of tongues employed is immaterial.

This number may be reduced to one or greater than two.

The arms which are provided in one embodiment shown on one of the tongues whereby its return spring acts on it and it acts on the piston of a piston-and-cylinder actuator may be replaced by other, equivalent means.

What I claim is:

1. Well pipe elevator comprising a ring having an interior volume and adapted to be fitted over a pipe from above, and at least one tongue carried by said ring and mounted for movement between a retracted position (I) for fitting the elevator to the pipe and a deployed position (III) for retaining the pipe, said at least one tongue projecting minimally into the interior volume of said ring in the retracted position and maximally into said interior volume in the deployed position, return spring means biasing said at least one tongue to a rest position intermediate said retracted and deployed positions, said return spring means being coupled at one end to the at least one tongue and at the other end to actuating means, retractor means for controlling said actuating means, said actuating means being displaceable between an advanced position corresponding to the rest, intermediate position of said at least one tongue and a withdrawn position corresponding to the deployed position of said at least one tongue.

2. Elevator according to claim 1, wherein the at least one tongue forms a fork bearingly engageable with the pipe along a circular sector.

3. Elevator according to claim 1, wherein the at least one tongue rotates about an axis orthogonal to the axis of said ring.

4. Elevator according to claim 3, wherein said ring has an internal shoulder, the at least one tongue bearing on said shoulder in the deployed position.

5. Elevator according to claim 1, comprising at least two tongues.

6. Elevator according to claim 5, wherein there are a plurality of said tongues, synchronizing means being operative between the plurality of the tongues.

7. Elevator according to claim 1, wherein said ring is circumferentially in one piece.

8. Well pipe elevator comprising a ring having an interior volume and adapted to be fitted over a pipe from above, and at least one tongue carried by said ring and mounted for movement between a retracted position (I) for fitting the elevator to the pipe and a deployed position (III) for retaining the pipe, said at least one tongue projecting minimally into the interior volume of said ring in the retracted position and maximally into said interior volume in the deployed position, return spring means biasing said at least one tongue to a rest position intermediate said retracted and deployed positions, said return spring means being coupled at one end to the at least one tongue and at the other end to actuating means, automatic retractor means for controlling said actuating means, said actuating means being displaceable between an advanced position corresponding to the rest, intermediate position of said at least one tongue and a withdrawn position corresponding to the deployed position of said at least one tongue.

9. Well pipe elevator comprising a ring having an interior volume and adapted to be fitted over a pipe from above and at least one tongue carried by said ring and mounted for movement between a retracted position (I) for fitting the elevator to the pipe and a deployed position (III) for retaining the pipe, said at least one tongue projecting minimally into the interior volume of said ring in the retracted position and maximally into said deployed position, return spring means biasing said at least one tongue to a rest position intermediate said retracted and deployed positions, said return spring means being coupled at one end to the at least one tongue and at the other end to actuator means, retractor means for controlling said actuating means, said actuating means being displaceable between an advanced position corresponding to the rest, intermediate position of said at least one tongue and a withdrawn position corresponding to the deployed position of said at least one tongue, said retractor means comprising a first piston-and-cylinder actuator having a first piston fixed for movement with the actuating means and first cylinder, and a second piston-and-cylinder actuator having second cylinder in fluid communication with the first cylinder, the first piston being operatively connected to said at least one tongue.

10. Elevator according to claim 9, wherein time-delay means controls said retractor means for delaying the return of the at least one tongue from the retracted position to the rest position.

11. Well pipe elevator comprising a ring having an interior volume and adapted to be fitted over a pipe from above and at least one tongue carried by said ring and mounted for movement between a retracted position (I) for fitting the elevator to the pipe and a deployed position (III) for retaining the pipe, said at least one tongue projecting minimally into the interior volume of said ring in the retracted position and maximally into said deployed position, return spring means biasing said at least one tongue to a rest position intermediate said retracted and deployed positions, said return spring means being coupled at one end to the at least one tongue and at the other end to actuating means, retractor means for controlling said actuating means, said actuating means being displaceable between an advanced position corresponding to the rest, intermediate position of said at least one tongue and a withdrawn position corresponding to the deployed position of said at least one tongue, said retractor means comprising a lever operatively connected to said actuating means, said actuating means in turn being operatively connected to said at least one tongue.

12. Elevator according to claim 11, wherein said lever is rotatably mounted on said ring, said actuating means being articulated to the lever and the at least one tongue being operatively connected to the lever by means of a plunger slidably mounted on said ring.

13. Elevator according to claim 11, wherein time-delay means controls the retractor means for delaying the return of said at least one tongue from the retracted position to the rest position.

* * * * *